US005195658A

United States Patent [19]

Hoshino

[11] Patent Number: 5,195,658

[45] Date of Patent: Mar. 23, 1993

[54] DISPOSABLE CONTAINER

[75] Inventor: Takahiro Hoshino, Yokohama, Japan

[73] Assignee: Toyo Bussan Kabushiki Kaisha, Tokyo, Japan

[21] Appl. No.: 664,129

[22] Filed: Mar. 4, 1991

[51] Int. Cl.[5] ..... B65D 37/00

[52] U.S. Cl. ..... 222/92; 206/219; 222/541; 222/564

[58] Field of Search ..... 222/92, 107, 541, 564; 206/219, 222

[56] References Cited

U.S. PATENT DOCUMENTS

| | | | |
|---|---|---|---|
| 3,964,604 | 6/1976 | Prenntzell | 206/219 |
| 4,526,823 | 7/1985 | Farrell et al. | 222/92 X |
| 4,551,371 | 11/1985 | Eckstein | 222/107 X |
| 4,759,472 | 7/1988 | Strenger | 222/92 |
| 4,872,556 | 10/1989 | Farmer | 222/107 X |
| 4,890,744 | 1/1990 | Lane, Jr. et al. | 222/92 X |
| 4,952,068 | 8/1990 | Flint | 206/219 X |
| 4,989,729 | 2/1991 | Huang | 206/222 |
| 5,026,283 | 6/1991 | Osanai et al. | 206/222 X |

FOREIGN PATENT DOCUMENTS

| | | | |
|---|---|---|---|
| 0078761 | 5/1983 | European Pat. Off. | 222/107 |

*Primary Examiner*—Andres Kashnikow
*Assistant Examiner*—Joseph A. Kaufman
*Attorney, Agent, or Firm*—Rogers & Killeen

[57] ABSTRACT

A disposable container for liquids may be squeezed to apply pressure to a sealed portion of the container to cause the sealed portion to rupture, thereby releasing the contents of the container. The sealed portion includes an inwardly projecting concavity with a nipple-like projection into the sealed portion of the container. When pressure is applied to the container, the nipple-like portion ruptures first, thereby facilitating rupture of the remainder of the sealed portion. A flow resistor may be included near the opening of the sealed portion to reduce the velocity of the contents of the container released upon rupture of the sealed portion.

18 Claims, 6 Drawing Sheets

(PRIOR ART)

DISPOSABLE CONTAINER

BACKGROUND OF THE INVENTION

1. Field of the Invention

The present invention relates to a disposable container for holding a low viscous liquid seasoning such as soy sauce, or liquid detergents, liquid toiletries, or the like. This disposable container is constructed in such a way that when the container is pressed by fingers or the palm of the hand a discharge opening ruptures and the contents can be discharged.

2. Description of the Related Art

In general, disposable containers have been hitherto constructed in such a manner that a notch for opening each container is formed in a sealing portion. When the containers are torn at this notch, the contents can be discharged.

In many conventional containers, however, it is difficult to tear the containers at the notch. For this reason, these conventional containers have the following problems: (1) when the container is being torn, the contents scatter, soiling clothing or the like; (2) in the case of the container for foods, torn pieces of the container often get in the food, which makes the food unclean; (3) the contents on these torn pieces may soil clothing or the like; and (4) there are no containers having a structure in which the seal can be readily broken or the opening can be readily made for fillers or the like in which two or more kinds of liquids are mixed together.

In view of the above problems, Japanese Unexamined Patent Publication No. 56-82849 discloses a disposable container which does not have these problems and which can be readily opened.

The disclosed container is made of a flexible sheet material, the edges of which container are sealed. The container is torn open to take out the contents. A sealing portion of the edge is formed so as to form an inverted V whose peak faces the inside of the container. When the container is pressed from the outside, the seal of the sealing portion begins peeling off at the peak of the inverted V. An opening made by this peeling is progressively formed along a predetermined path, whereby the contents are caused to flow out in a predetermined direction.

However, after the disclosed container has been manufactured on an experimental basis and actually been used, it is seen that there still remain certain problems.

That is, it is difficult to tear the container, since the outline of the sealing portion to which pressure is applied is formed so as to face simply the inside of the container, this sealing portion being formed where the opening is formed through which the contents flow out.

Furthermore, the container, as mentioned above, is the type in which when pressure is applied to rupture the sealing portion, an opening is formed through which the contents are forced out. Therefore, this difficulty, together with the above difficulty in tearing, results in a problem in that, once an opening is formed, the contents are suddenly forced out of the opening, and thus scatter around. A problem further arises in that it is difficult to make the contents flow in a predetermined direction.

SUMMARY OF THE INVENTION

The present invention overcomes the problems mentioned above. The object of the invention is to provide a type of disposable container in which, when it is pressed so as to rupture a sealing portion, an opening is formed. The container can thus be readily opened. The contents are not forced out of the opening of the container, in other words, it is possible to force the contents in a direction in which one wants the contents to flow.

To achieve the above object, this invention provides a bag-like disposable container constructed in such a manner that filmy sheets on which synthetic resin films or aluminum foils may be laminated, are stacked. Three or four sides of the stacked sheets may be sealed, wherein a sealing portion having a discharge opening, through which the contents flow and which is to be formed by rupturing this sealing portion, formed of a narrow seal. The sealing portion substantially looks like a bell or mountain, and has a small projected sealing portion, which looks like a nipple, at the peak of the bell-like or mountain-like sealing portion. A circulating resistive portion is formed near the discharge opening formed in the container.

DESCRIPTION OF THE PREFERRED EMBODIMENTS

The embodiments of the present invention will now be described with reference to the drawings.

Figure 8:
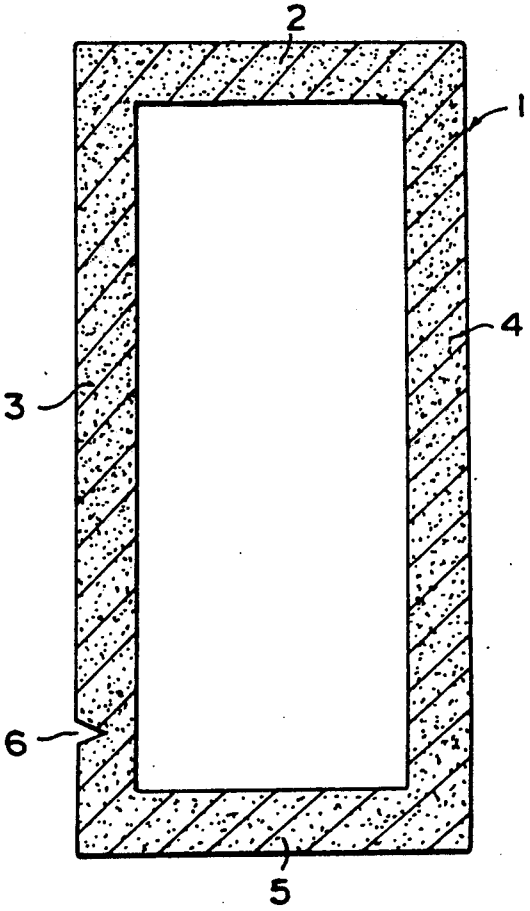
(PRIOR ART) FIG. 8

In the drawings, numeral 1 denotes a bag-like container which is formed in either one of the following two manners: Two sheet materials at least opposite sides of which can be heat-sealed are laid on top of the other, and the three or four sides of these sheet materials are heat-sealed 2-5; or one sheet material is folded into two in a longitudinal direction thereof, and the three or four sides of this sheet material are heat-sealed 2-5. As shown in FIG. 8, a notch 6 is formed in a sealing portion 3 of the conventional container, where an opening for tearing is to be made. This opening is thus made by tearing the container from this notch 6. This invention may be applied to a heat-sealable bag-like container as well as to an adhesive-type bag-like container.

As mentioned earlier, however, there are various problems in the structure having such an opening.

Figure 9:
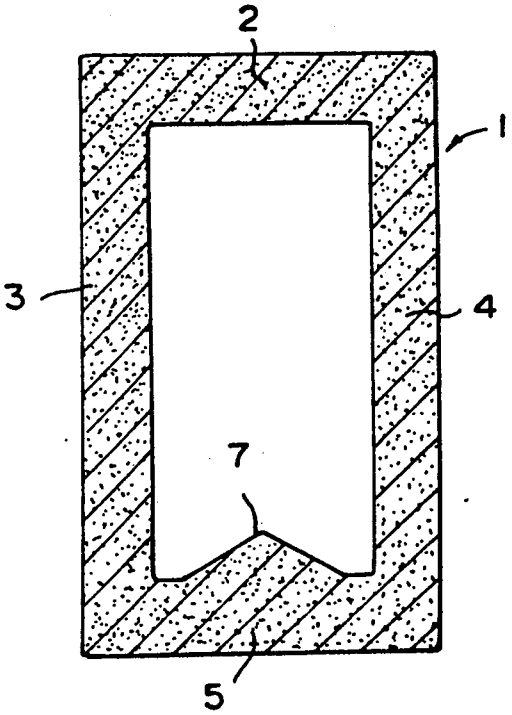
FIGS. 8 and 9 are each horizontal cross-sectional views of the conventional art.

In view of these problems, a container shown in FIG. 9 has hitherto been proposed. Pressure is applied to this container which has no notch formed so as to make a sealing portion 5 project into the container 1 in an inverted V-shaped manner, whereby a portion 7 is ruptured.

In the proposed container, however, there is a problem in the configuration of a sealing portion 2 which includes the portion 7 where an opening is to be made.

Because of this problem, it is not easy to make the opening. Also, it is found that when a substantial amount of pressure is applied to forming the opening, the liquid in the container spills because of this pressure. The present invention shown in FIGS. 1-7 has been made to overcome these problems.

The same reference characters in FIGS. 1-7 as those in FIGS. 8 and 9 designate like members. (1) A sealing portion 8 to be ruptured is formed inside the container 1: (2) A chamber 10, for reducing the flow velocity of the contents, is formed between the sealing portion 8 and an opening 9, which is made beforehand in the sealing portion 5; or a flow velocity reducing portion 11 is formed. These two points are unique features of the invention, which will be explained with reference to FIGS. 1-7.

Figure 1:
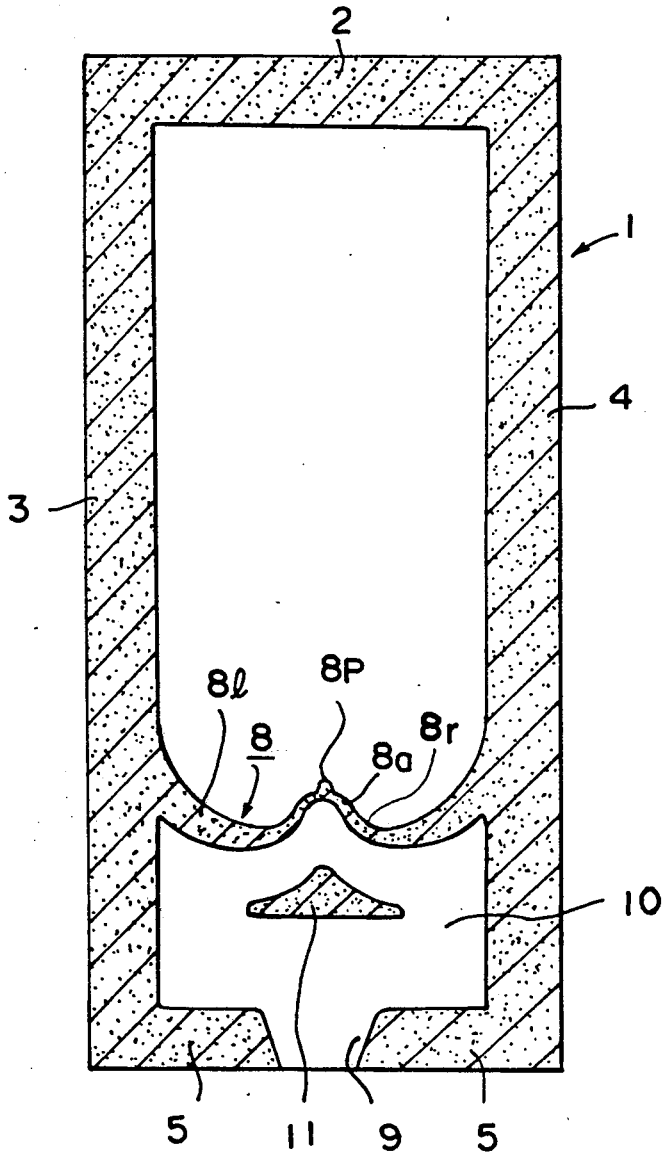
FIG. 1 is a horizontal cross-sectional view of a first embodiment of a container in accordance with the present invention.

In a first embodiment of FIG. 1, the sealing portion 8 formed inside the container 1 is constructed in the following way: A right seal line 8*r* and a left seal line 8*l* are formed in a substantially straight line, or in such a manner as to form valleys of gentle slopes. A narrow seal line 8*a* to be ruptured is formed substantially at the center of the sealing portion 8, this narrow seal line 8*a* being connected to the above two seal lines 8*r* and 8*l*. The peak of this bell-shaped or mountain-like seal line 8*a* faces the inside of the container 1. Furthermore, a nipple portion 8*p* is formed at this peak. As depicted in FIG. 1, the narrow seal line 8*a* may have a width that decreases from an edge thereof to the nipple portion 8*p* to facilitate rupture of the seal.

As illustrated in FIGS. 1-7, the nipple portion 8*p* has an inverted U-shape that projects into the container 1 beyond the farthest inward projection of the seal line 8*a*.

In FIG. 1, the chamber 10 is formed between the sealing portion 8 and the opening 9. A resistive sealing portion 11 serving as a flow velocity reducing portion is formed in the chamber 10, directly under the peeling seal line 8*a*. In this embodiment, a triangle resistive sealing portion is utilized as the sealing portion 11.

The above structure of the container 1 permits a liquid in the container 1 to be readily extracted from the opening 9 at a reduced flow velocity of the liquid.

In other words, when the container is pressed as when tightly grasped, the stress caused by this pressure is centered on the nipple 8*p* of the seal line 8*a* of the sealing portion 8. The seal of the sealing portion 8 is ruptured at the nipple 8*p*, thereby causing the contents to start flowing toward the chamber 10. Though depending on pressure, the nipple 8*p* is ruptured along the seal line 8*a*, thus substantially forming an opening, consequently causing more of the contents to flow.

The contents (liquid) are caused to flow rapidly into the chamber 10 through an opening which is made as a result of rupturing the sealing portion 8. However, because the resistive sealing portion 11 is formed in the chamber 10, the contents, flowing through the opening, are not caused to flow directly to the outside through the opening 9, which is made beforehand in the sealing portion 5. The contents first stay in the chamber 10 because of the resistive sealing portion 11, and then flow to the outside through the opening 9. They will not be forced out directly from the container 1 in the way the contents do in the conventional art. The opening 9 may be formed arbitrarily in any position, so long as it is connected to the chamber 10.

Figure 2:
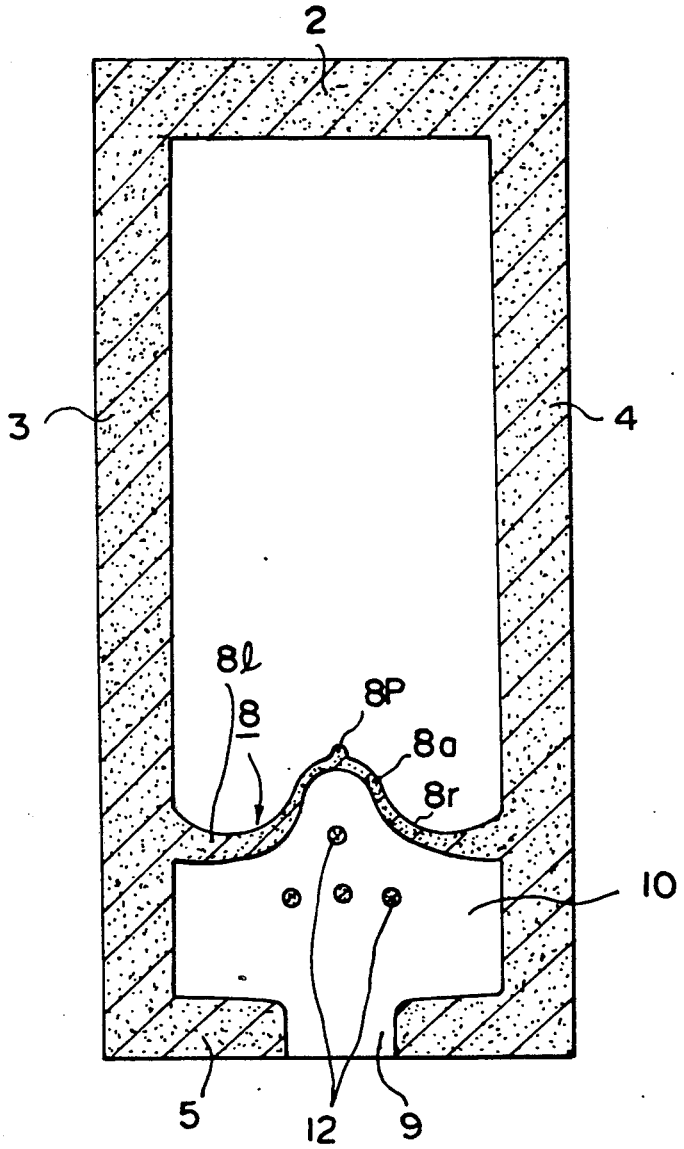
FIG. 2 is a horizontal cross-sectional view of a second embodiment of the container.
Figure 3:
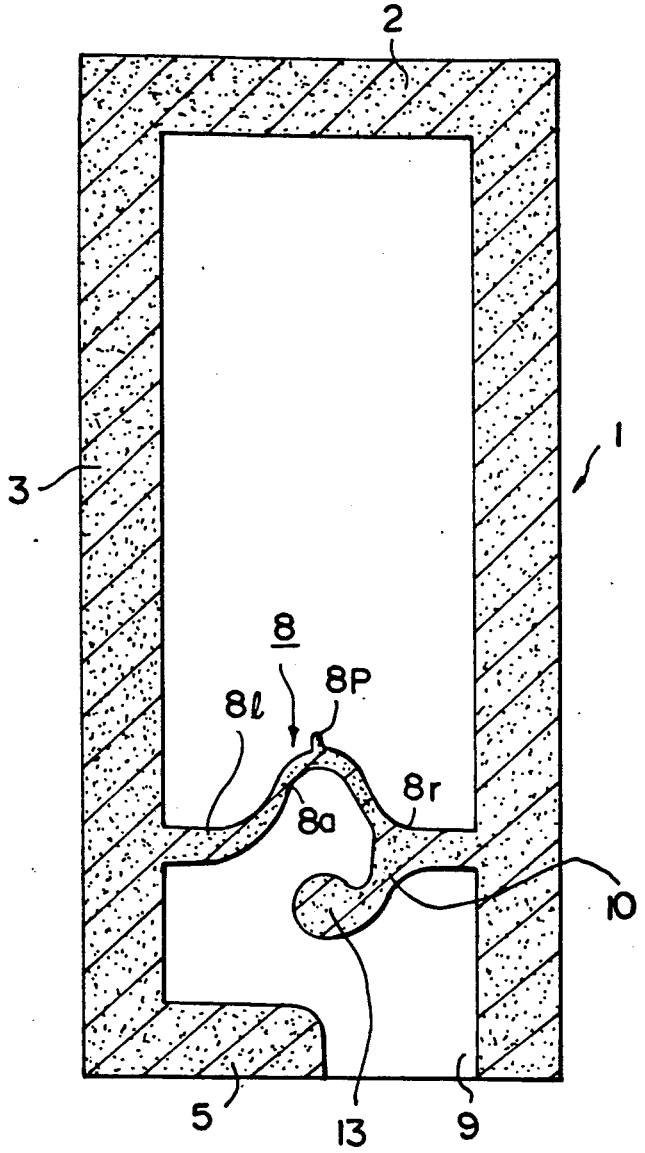
FIG. 3 is a horizontal cross-sectional view of a third embodiment of the container.

The resistive sealing portion in the first embodiment may also be formed as shown in FIGS. 2 and 3.

In a second embodiment of FIG. 2, a plurality of dot-like resistive sealing portions 12 are formed as flow velocity resistive portions in the chamber 10.

In a third embodiment of FIG. 3, a bowl-like resistive sealing portion 13 connected either to the right seal line 8*r* or to the left seal line 8*l* is formed in the chamber 10. The sealing portion 13 serving as a flow velocity resistive portion is so designed as to change the flow path of the contents in the chamber 10.

Needless to say that the flow velocity resistive portions in FIGS. 1-3 can be arbitrarily designed or changed in accordance with the size or quantity of the sealing dots of these resistive portions. The shape of the flow path in the chamber 10 can also be arbitrarily designed or changed in accordance with the viscosity of the contents, i.e., liquid, or the like.

Figure 4:
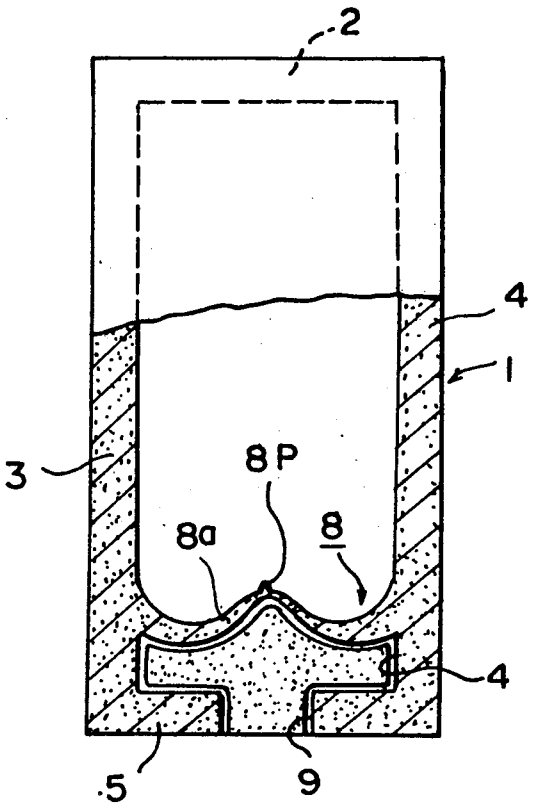
FIG. 4 is a horizontal cross-sectional view of a fourth embodiment of the container.

In a fourth embodiment of FIG. 4, for example, a coarse open-cell foam 14 used as a flow velocity resistive element is charged in the chamber 10. Such a flow velocity resistive element formed of the open-cell foam 14 is suitable especially for low viscous liquids such as water or juice.

Figure 5:
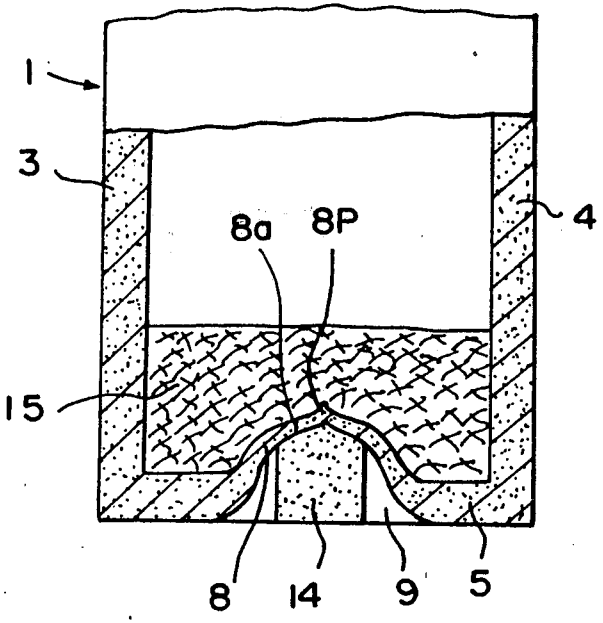
FIG. 5 is a horizontal cross-sectional view of a fifth embodiment of the container.
Figure 6:
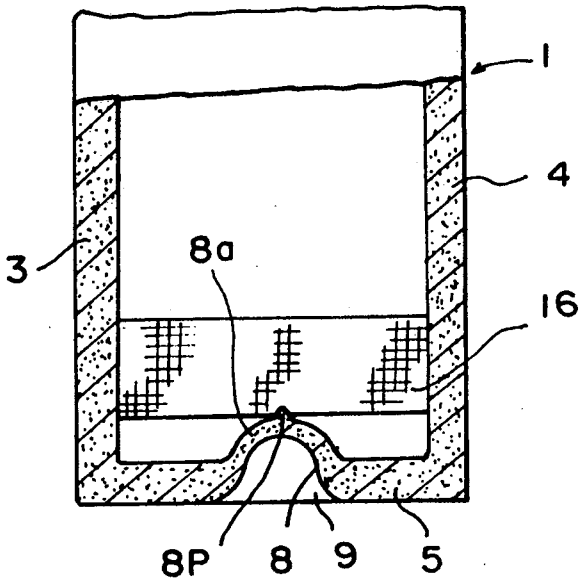
FIG. 6 is a horizontal cross-sectional view of a sixth embodiment of the container.

The flow velocity resistive element formed of such a open-cell foam 14 allows the contents (liquid) to flow out at a remarkably reduced rate, so therefore, the shape of the chamber 10 can be made simple as illustrated in FIGS. 5 and 6, which show fifth and sixth embodiments. In such a case, the flow velocity resistive element made of the open-cell foam 14 or a similar material may be arranged near the opening in the container 1.

The flow velocity resistive element is not limited to the open-cell foam 14 in the fourth embodiment. A member in which a liquid can soak, such as nonwoven fabric 15 or a interwoven fabric material 16, may also be utilized as the flow velocity resistive element.

Figure 7:
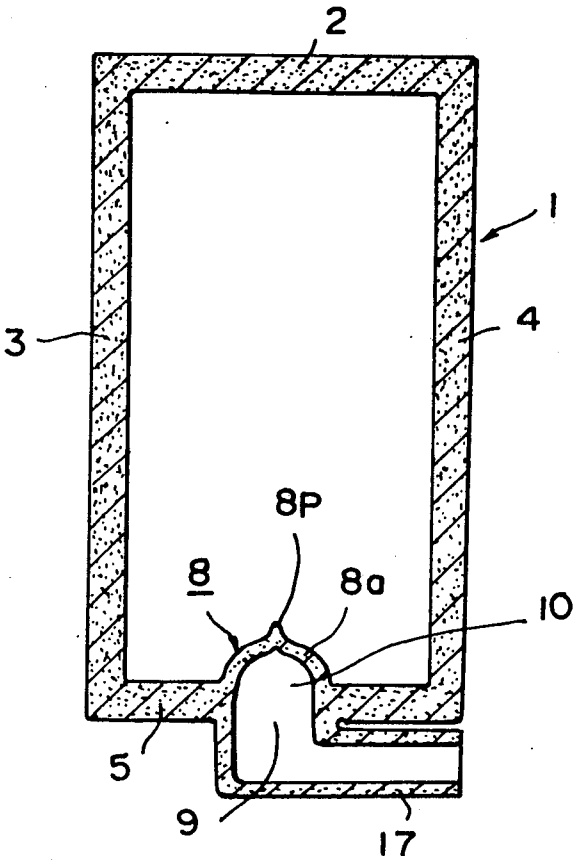
FIG. 7 is a horizontal cross-sectional view of a seventh embodiment of the container.

In a seventh embodiment of FIG. 7, a straw-like passageway 17 through which the contents are discharged or sucked is connected to the opening 9 or the chamber 10 formed inside the container 1, and is integrally formed with the container 1.

With the thus-constructed container 1, it is convenient for one to suck the contents, such as drinking water, through the straw-like passageway 17.

Two or more containers described above in accordance with the present invention may be arranged in parallel in the longitudinal directions thereof, or may be stacked one on top of another in the thickness directions thereof. Containers having such a construction in which they are arranged in rows or stacked one on top of another are suitably used for extracting two or more kinds of liquids at the same time.

As has been described above, in the type of container in which pressure applied to the container partially helps rupture the sealing portion, so that the contents can be extracted, the opening made is formed along the substantially narrow bell-like or mountain-like seal line. Since the nipple-like projection is formed on the peak of the seal line, the opening made by applying pressure can be easily formed.

In addition, because the chamber for reducing and easing the flow velocity of the contents is formed between the ruptured and the opening which is made beforehand in the sealing portion, the contents flowing out under pressure will not be directly forced out. This is a unique advantage of the present invention.

What is claimed is:

1. A bag-like disposable container comprising:

plural sheets having sealed sides forming a cavity for holding contents of the container;

a sealing portion having a concave discharge opening through which the contents of said container may flow and which is to be opened by rupture of said sealing portion;

a small projected sealing portion on the cavity-facing surface of said sealing portion, the small projected sealing portion being inverted-U-shaped and projecting into said cavity beyond the farthest projection therein of said sealing portion; and a circulating resistive portion near the discharge opening.

2. A bag-like disposable container according to claim 1, wherein said sealing portion is formed inside said container near an opening in one of said sealed sides.

3. A bag-like disposable container according to claim 2, wherein contours of lower slopes of said sealing portion are gentle valley-like lines drawn toward both sides of said container, and wherein the bottom of the valley si formed so as to be connected to said sealing portion.

4. A bag-like disposable container according to claim 2, wherein the circulating resistive portion is in a chamber between the sealing portion and the opening in one of said sealed sides.

5. A bag-like disposable container according to claim 4, wherein a circulating resistive element is arranged in the chamber so as to form the circulating resistive portion.

6. A bag-like disposable container according to claim 1, wherein contours of lower slopes of said sealing portion are gentle valley-like lines drawn toward both sides of said container, and wherein the bottom of the valley is formed so as to be connected to said sealing portion.

7. A bag-like disposable container according to claim 6, wherein the circulating resistive portion is in a chamber between the sealing portion and the opening in one of said sealed sides.

8. A bag-like disposable container according to claim 7, wherein a circulating resistive element is arranged in the chamber so as to form the circulating resistive portion.

9. The bag-like disposable container as defined in claim 1 wherein said sheets comprise synthetic resin films.

10. The bag-like disposable container as defined in claim 1 wherein said sheets comprise aluminum foil.

11. The bag-like disposable container as define din claim 10 wherein said sheets of aluminum foil are laminated.

12. The container as defined in claim 1 wherein the circulating resistive portion is in a chamber between said sealing portion and said opening in one of said sealed sides.

13. A bag-like disposable container according to claim 12, wherein a circulating resistive element is arranged in the chamber so as to form the circulating resistive portion.

14. A container having a seal ruptured by the application of pressure to the container comprising:

plural sheets having sealed sides forming a cavity therebetween, one of said sides having an unsealed portion for allowing discharge from said cavity;

said sheets having a sealed portion forming a concavity in said cavity internal to said unsealed portion that ruptures upon application of pressure to the container; and said sealed portion having an inverted-U-shaped nipple on a cavity facing surface projecting into said cavity farther than said sealed portion, whereby the application of pressure to the container to effect discharge from the cavity causes said nipple to rupture first so as to more easily enable rupture of the remainder of the sealed portion.

15. The container as defined in claim 14 wherein said sealed portion has a width that decreases from an edge thereof to said nipple to facilitate rupture of the said sealed portion.

16. The container as defined in claim 14 further comprising flow restriction means between said sealed portion and said unsealed portion for slowing flow from said unsealed portion upon rupture of said sealed portion.

17. In a closed bag-like container having a concavity in one side thereof, the wall of which is ruptured to release the contents from the interior of the container, the improvement comprising:

an inverted-U-shaped projection on an interior-facing surface of said concavity that projects into the interior of the container farther than said concavity for facilitating the rupture of said wall.

18. In a bag-like container having at least one sealed side and a concavity in one said sealed side, the wall of said concavity being ruptured to release the contents from the interior of the container, the improvement comprising:

inverted-U-shaped rupture means on an interior-facing surface of said concavity for facilitating the rupture of said wall, said rupture means extending into said interior farther than said concavity.

* * * * *